United States Patent [19]

Jantzen

[11] Patent Number: 4,712,735

[45] Date of Patent: Dec. 15, 1987

[54] PRESTRESSED CONCRETE CROSS TIE HAVING INCREASED FATIGUE LIFE

[75] Inventor: Steven L. Jantzen, 404 E. Pearle Apt. #6, Jerseyville, Ill. 62052

[73] Assignee: Steve L. Jantzen, Jerseyville, Ill.

[21] Appl. No.: 767,857

[22] Filed: Feb. 6, 1986

Related U.S. Application Data

[63] Continuation of Ser. No. 521,274, Aug. 8, 1983, abandoned.

[51] Int. Cl.[4] ..... E04C 3/10

[52] U.S. Cl. ..... 238/94; 52/223 R

[58] Field of Search ..... 52/223, 723, 227, 223 L; 238/94, 91, 85, 84, 83

[56] References Cited

U.S. PATENT DOCUMENTS

| | | | |
|---|---|---|---|
| 999,766 | 8/1911 | Fassett | 238/91 |
| 1,097,082 | 5/1914 | Cornelius | 238/91 |
| 2,413,990 | 1/1947 | Mantz | 52/223 |
| 2,496,850 | 2/1950 | Bertrand | 52/223 |
| 2,538,437 | 1/1951 | Bagon | 238/91 |
| 2,695,754 | 11/1954 | Karig | 238/91 |
| 3,416,272 | 12/1968 | La Gue | 52/223 R |
| 4,116,010 | 9/1978 | Vidal | 405/262 |
| 4,373,837 | 12/1983 | Lin | 52/223 |

OTHER PUBLICATIONS

Materials and Methods of Architectural Construction © 1958, by John Wiley & Sons, Inc.

*Primary Examiner*—Henry E. Raduazo
*Attorney, Agent, or Firm*—Henry W. Cummings

[57] ABSTRACT

In a prestressed concrete cross tie, a layer of steel reinforcements are located at or near the neutral axis of the cross tie section to minimize fatigue stress fluctuations. Deviation from the neutral axis is not great enough to cause stress fluctuations to exceed the endurance limit of the material. Because fatigue failure of prestressed concrete members is principally associated with reinforcement failure, increased fatigue life of the cross tie is achieved.

5 Claims, 6 Drawing Figures

ENDURANCE LIMIT (STRAND STRESS UNDER WHICH FATIGUE IS NOT A CONSIDERATION)
STRESS IN STRAND AT DESIGN LOAD
PRESTRESS (STRAND STRESS-UNLOADED TIE)

PRESTRESSED CONCRETE CROSS TIE HAVING INCREASED FATIGUE LIFE

This is a continuation, of application Ser. No. 521,274, filed Aug. 8, 1983 and now abandoned.

BACKGROUND OF THE INVENTION

In U.S. Pat. Nos. 1,268,235, 2,538,443, and 2,695,754, reinforcements for concrete cross ties are provided at a single level within the cross tie, and are stressed after the concrete is poured in place through the use of mechanical fasteners at either end of the cross tie reinforcement.

In U.S. Pat. No. 1,072,053, a prestressed concrete cross tie reinforcement is provided which varies in its location from a low point below each track member to an upper location in the center portion of the transverse cross tie.

In none of these references is there any recognition of the desirability of locating the reinforcements at the neutral axis of the section to increase the fatigue life.

In U.S. Pat. No. 1,130,081, the concrete reinforcement makes a 90° bend at either end, and the stressing mechanical fasteners are located adjacent the rails.

In U.S. Pat. Nos. 4,108,377 and 4,150,790, reinforcements for concrete cross ties are provided which are vertically spaced and which are prestressed before the concrete is poured.

However, neither of these constructions have the reinforcements located at the neutral axis of the section or is there any realization that locating the reinforcements at the neutral axis of the section will reduce fatigue.

Furthermore, no attempt is made at minimizing concrete and maximizing strength.

SUMMARY OF THE INVENTION

The object of the invention is to provide a prestressed concrete cross tie reinforcement arrangement which increases the fatigue life of the cross tie while at the same time the concrete cross tie complies with the American Railway Engineering Association (AREA) specification for concrete ties.

Another object of the present invention is to reduce the number of reinforcements required for a given concrete cross tie while at the same time increasing the fatigue life of the cross tie.

Another object of the invention is to provide prestressed concrete cross ties in which the stress fluctuations due to flexure do not exceed the endurance limit.

In accordance with the present invention, a single layer of mechanical reinforcements is provided in the prestressed concrete cross tie wherein the layer of reinforcements is located at or near the neutral axis of the section. In order to locate the layers at the same height throughout the cross tie, the layers are located near the neutral axis of the section in substantially all sections across the transverse extent of the cross tie. Preferably, the reinforcements are located a distance above or below the neutral axis of the section such that stress fluctuations do not exceed the endurance limit of the material.

In some portions of the cross tie, the layer is located above the neutral axis and in other portions the layer is located below the neutral axis of the section.

IN THE DRAWINGS

FIG. 7 is a diagram showing stress fluctuations and the endurance limit of a fully loaded cross tie.

DESCRIPTION OF THE PREFERRED EMBODIMENTS

Figures 1, 2, 3, 4, 5, 6, 7:
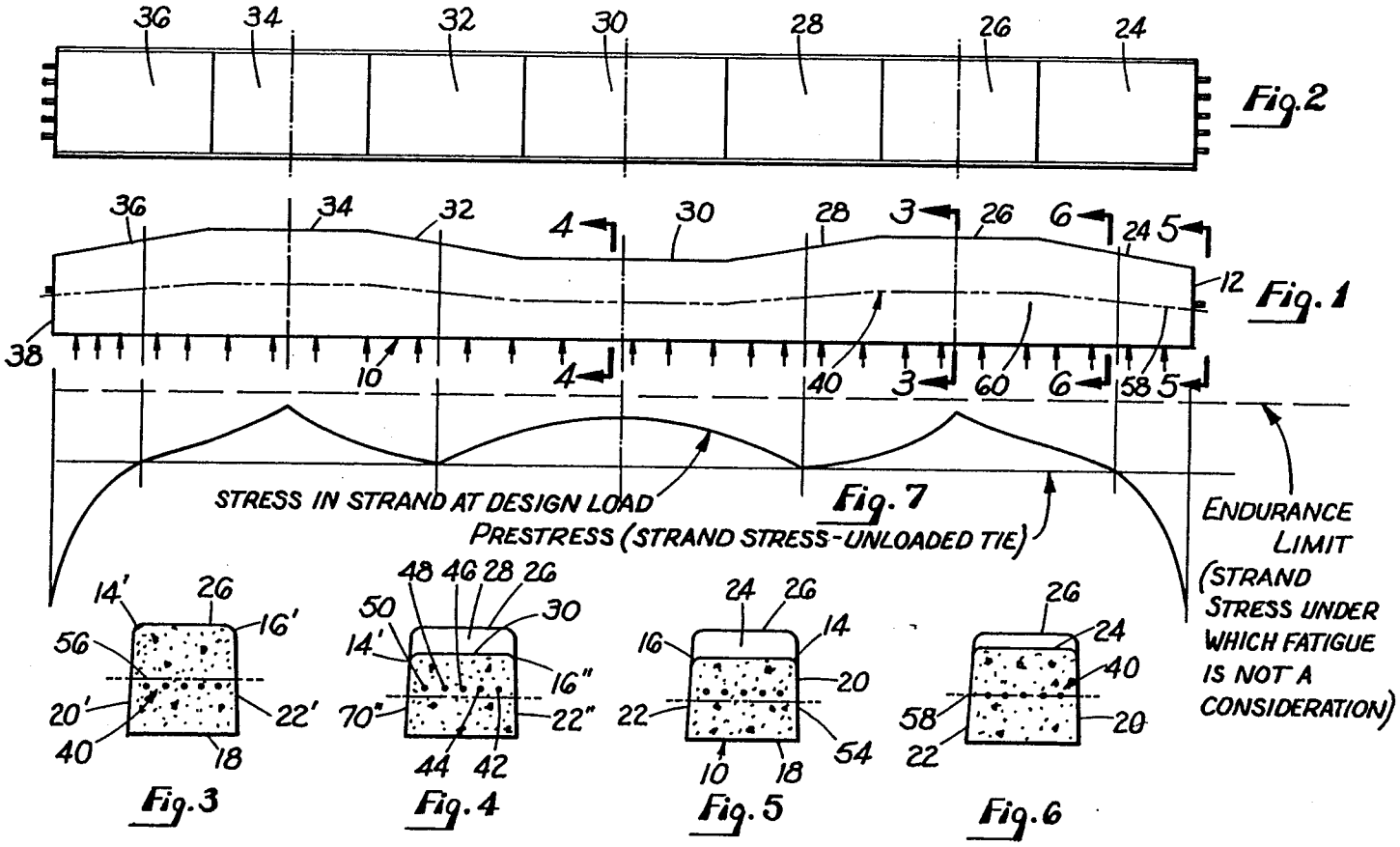
FIG. 1 is a side elevation view of a concrete cross tie according to the present invention.
FIG. 2 is a plan view of the concrete cross tie illustrated in FIG. 1.
FIG. 3 is a sectional view looking in the direction of the arrows along the line 3—3 in FIG. 1.
FIG. 4 is a sectional view looking in the direction of the arrows along the line 4—4 in FIG. 1.
FIG. 5 is an end view of the cross tie illustrated in FIG. 1.
FIG. 7 shows the deflection pattern across the tie.
FIG. 6 is a sectional view looking in the direction of the arrows along the line 6—6 in FIG. 1, and illustrating a section wherein the strands are located at the neutral axis of the section.

The prestressed concrete cross tie of the present invention is indicated in the drawings generally at 10.

As is apparent from FIG. 2, the cross tie is generally rectangular in plan.

The concrete used to make the cross tie is such as to meet the requirements of A.R.E.A. specification 10.22 which includes a minimum 28 day compressive strength of 7,000 psi.

As will be apparent from FIG. 1, the cross tie varies in cross section.

Looking at the cross tie from right to left as shown in FIG. 5, the cross section at the end 12 is rectangular. However, at the upper portion of the section at areas 14 and 16, the section is rounded. In one embodiment, this portion has a height of a-proximately 7½", and a base distance across the end of 10". This distance does not vary across the cross tie. However, the sides 20 and 22 are tapered inwardly until curved portions 14 and 16 are encountered.

The concrete tie includes a first inclined portion 24 which extends from the end to a first rail portion 26 which supports a railroad track rail. The length of the inclined portion 24 is commonly 14". The length of rail portion 26 is commonly 14". Portion 26 is commonly 10" above the base 18. This is one area where the deflection is maximum.

As one looks further transversely from the end 12, the cross tie includes a second inclined portion 28 which is inclined downwardly for a distance conveniently of 14" to a lower midpoint flat portion 30 located generally at the midpoint of the tie, which is subject to tension under load.

As shown in FIG. 3, the sides 20' and 22' are extended to a greater height over that illustrated in FIG. 5. However, curved top portions 14' and 16' are again provided.

In the midportions 30 and the sides 20" and 22" are again foreshortened to generally the same height as FIG. 5, but include curved end portions 14" and 16".

Moving further across the transverse extent of the cross tie, a third inclined portion 32 is encountered generally of the same incline as portions 24 and 28. Inclined portion 32 is commonly 14" in its transverse extent, and terminates in a second rail portion 34, commonly of 14", and of the same height as first rail portion 26. The cross section of rail portion 34 is the same as the cross section of rail portion 26 including elongated sides 20' and 22' and curved upper portions 14' and 16'. Portion 34 supports the second rail of the track.

The inclined portion 36 of the tie is inclined downwardly to a second end portion 38 having the same cross section as illustrated in FIG. 5. The inclined portion 36 is commonly 14" in length, and is inclined at the same inclination as portion 24.

In accordance with the present invention, metallic reinforcing means indicated generally at 40 are provided which extend transversely through the concrete. A reinforcing means 40 includes a plurality of metallic rods 42, 44, 46, 48 and 50. While five rods are illustrated in the drawings, more or less rods may be utilized.

However, the metallic rods are located at or near the neutral axis of each of the sections which may be taken across the transverse section of the cross tie. For example, in FIGS. 4 and 5, the neutral axis of the section respectively indicated at 52 and 54, is located below the layer of strands 40. However, in portions 26 and 34 as indicated in FIG. 3, the reinforcing means 40 is located below the neutral axis 56. The sections illustrated in FIGS. 3, 4 and 5 indicate the maximum deviation of the reinforcing means 40 from the neutral axis of the section. Preferably, this deviation is such that stress fluctuations do not exceed the endurance limit of the material. In this regard it will be noted that since the vertical height in the cross sections in portions 26 and 34 is greater than the vertical extent of the cross sections at 12, 30 and 38, that somewhat more deviation is permitted from the neutral axis in these areas which have a greater vertical extent.

The reason why it is desirable to locate the reinforcing means 40 at or near the neutral axis of the section is to reduce the fatigue loads which the section sees due to on and off loads applied by trains passing over the respective sections 26 and 34. If the reinforcing means 40 are located at or near the neutral axis of the section, the amount of load variation seen by reinforcing means is insignificant as compared to the endurance limit of the material. Thus increased life of cross ties is obtained by locating the reinforcements at or near the neutral axis of each section in the cross tie.

The cross tie varies in cross sectional area because strength requirements vary, and to save material. Also, there is a weight limitation. Thus, the reinforcement means cannot be simultaneously located at the neutral axis of each section because the section varies in the portions 24, 28, 30, 32 and 36 over the load carrying sections 26 and 34. Deviation from the neutral axis illustrated in FIGS. 3 and 4 is entirely satisfactory condition according to the present invention so long as the deviation does not allow stress fluctuations to exceed the endurance limit of the material. See FIG. 7.

The formula for calculation of the neutral axis of a section is known to those in the art. Thus it is well within the skill of practicing engineers to determine where the neutral axis is located and to locate the ties at a single distance above the base 18 such as to be at or near the neutral axis of each section.

While steel reinforcements are preferred, for example ASTM A416 grade 270, this material has an endurance limit of about 200,000 psi. Five (5) 7/16" diameter strands prestressed to 104,000 pounds per square inch are preferred, other suitable strands may be utilized either made of steel or aluminum or other load bearing materials. Preferably the endurance limit of the material is about 200,000 psi or higher.

It would not be permitted according to the requirements of American Railway Engineering Association standards to utilize a cross tie having the same cross section all the way across the tie and simply to locate the reinforcing means at the neutral axis of this section. Not only would this railway specification now be complied with, but also it would waste concrete because unneeded concrete would be utilized in the portions 24, 28, 30, 32 and 36, and the tie would weigh in excess of maximum weight in the specification.

It is thus apparent that the location of the ties relative to the neutral axis of the section will vary from an initial location above the neutral axis of the section at the end of portion 12 to a location below the neutral axis of the section at portion 26. Somewhere during inclined portion 28 the strands will be located at the neutral axis of the section and in the portion 30 the strands will be located above the neutral axis of the section as was the case at the end portion 12. Similarly, in the inclined portion 32 it will be a point within this section when the strands are located at the neutral axis of the section and in load bearing section 34 the strands will be again located below the neutral axis of the section. Similarly, in section 36 there will be a point where the strands are located at the neutral axis of the section and at the end portion 38 the strands will again be located above the neutral axis of the section. The variation of the neutral axis of the section is illustrated in FIG. 1 by the line 58, and it is seen at the end portion , it is below the center line 60 of the reinforcing means 40 and then rises to a point above the center line of the ties in portion 26. In portion 28 it again crosses the tie center line and is located below the tie center line in portion 30. The neutral axis again rises in portion 34 and is located above the tie center in portion 34. In portion 36 the neutral axis again lowers and an end portion 38 is located below the center line of the ties.

Concrete ties having the reinforcement means of the present invention will meet the 3,000,000 cycle test of the American Railway Engineering Association which corresponds to a fatigue life in excess of 50 years for the concrete ties of the present invention. 3,000,000 cycles correspond roughly to infinite life. In other words, if the structure can exceed 3,000,000 cycles, it will in all liklihood go on indefinitely at that load level.

It is thus seen that an improved concrete tie construction has been obtained with the present invention.

I claim:

1. A prestressed concrete tie assembly comprising:

a concrete tie body wherein the cross section of the body varies transversely across the tie and includes a pair of track support portions of large cross sections, end portions of reduced cross sections, and a center portion of reduced cross section;

a plurality of prestressed metallic rods spaced across the transverse extent of the concrete body and extending throughout the longitudinal extent of the body;

said concrete body having a neutral axis which varies according to the cross section of the body portion;

said rods being located at a single level within the concrete body, and at the same time being located sufficiently near the varying neutral axis of the concrete body whereby stress fluctuations in the rods do not exceed the endurance limit of the rod material, and wherein in the track support portions of the body, the strands are located below the neutral axis of the section, and wherein at the center and end portions of the body the strands are located above the neutral axis of the section.

2. A prestressed concrete tie assembly according to claim 1, wherein the tie includes a plurality of inclined portions within which at least one point therein the reinforcing strands are located at the neutral axis of the cross section of the inclined portion.

3. A prestressed concrete tie assembly according to claim 2, wherein steel reinforcement are used.

4. A prestressed concrete tie assembly according to claim 3, wherein aluminum reinforcement are used.

5. A prestressed concrete tie assembly according to claim 1, wherein said reinforcements have a yield strength of at least about 200,000 psi.

* * * * *